US007414599B2

(12) United States Patent
Chung et al.

(10) Patent No.: US 7,414,599 B2
(45) Date of Patent: Aug. 19, 2008

(54) ORGANIC LIGHT EMITTING DEVICE PIXEL CIRCUIT AND DRIVING METHOD THEREFOR

(75) Inventors: Ho-Kyoon Chung, Yongin-si (KR); Yang-Wan Kim, Seoul (KR); Choon-Yul Oh, Gunpo-si (KR); Oh-Kyong Kwon, Seoul (KR); Sang-Moo Choi, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 674 days.

(21) Appl. No.: 10/886,014

(22) Filed: Jul. 6, 2004

(65) Prior Publication Data

US 2005/0017934 A1 Jan. 27, 2005

(30) Foreign Application Priority Data

Jul. 7, 2003 (KR) ..... 10-2003-0045610

(51) Int. Cl.
*G09G 3/30* (2006.01)

(52) U.S. Cl. ..... 345/76; 315/169.3

(58) Field of Classification Search ... 315/169.1–169.4; 345/76–83

See application file for complete search history.

(56) References Cited

U.S. PATENT DOCUMENTS

| | | | | |
|---|---|---|---|---|
| 6,091,203 | A | 7/2000 | Kawashima et al. | |
| 6,229,506 | B1 * | 5/2001 | Dawson et al. | 345/82 |
| 6,362,798 | B1 | 3/2002 | Kimura et al. | |
| 2003/0067424 | A1 | 4/2003 | Akimoto et al. | |
| 2004/0041750 | A1 * | 3/2004 | Abe | 345/76 |

(Continued)

FOREIGN PATENT DOCUMENTS

| | | | |
|---|---|---|---|
| CN | 1361510 | A | 7/2002 |

(Continued)

OTHER PUBLICATIONS

Korean Patent Abstracts, Publication No. 1020020025842 A, dated Apr. 4, 2002, in the name of Katsuya Anzai et al.

(Continued)

*Primary Examiner*—Alexander Eisen
*Assistant Examiner*—Hoai-Quan T Ho
(74) *Attorney, Agent, or Firm*—Christie, Parker & Hale, LLP

(57) ABSTRACT

A pixel circuit in an organic light emitting device capable of realizing high gradation representation by self-compensating a threshold voltage, and a method for driving the same. The pixel circuit includes an electroluminescent element for emitting light in response to an applied driving current. A first transistor delivers a data signal voltage in response to a current scan line signal. A second transistor generates a driving current to drive the electroluminescent element in response to the data signal voltage. A third transistor connects the second transistor in the form of a diode in response to a current scan signal to self-compensate the threshold voltage of the second transistor. A capacitor stores the data signal voltage delivered to the second transistor. A fourth transistor delivers a power supply voltage to the second transistor in response to a current light-emitting signal. A fifth transistor provides the driving current, provided from the second transistor, for the electroluminescent element in response to the current light-emitting signal.

18 Claims, 5 Drawing Sheets

U.S. PATENT DOCUMENTS

2004/0145547 A1* 7/2004 Oh ..... 345/76

FOREIGN PATENT DOCUMENTS

| | | |
|---|---|---|
| EP | 1 220 191 | 7/2002 |
| JP | 2000-347621 | 12/2000 |
| JP | 2002-215096 | 7/2002 |
| JP | 2002-244617 | 8/2002 |
| JP | 2003-173165 | 6/2003 |
| JP | 2003-202833 | 7/2003 |
| JP | 2003-223138 | 8/2003 |
| JP | 2004-133240 | 4/2004 |
| KR | 2002-0025842 | 4/2002 |

OTHER PUBLICATIONS

Office Action dated Dec. 1, 2006 for corresonding Chinese Patent Application No. 200410063736.X (including English translation).

Korean Patent Abstracts, Publication No. 1020020056353 A; Publication Date: Jul. 10, 2002; in the name of Kwon.

European Search Report dated Apr. 23, 2007, for EP 04090270.2, in the name of Samsung SDI Co., Ltd.

Patent Abstracts of Japan, Publiction No. 2000-347621, dated Dec. 15, 2000, in the name of Yuji Kondo, et al.

Patent Abstracts of Japan, Publiction No. 2002-215096, dated Jul. 31, 2002, in the name of Oh-Kyong Kwon.

Patent Abstracts of Japan, Publiction No. 2002-244617, dated Aug. 30, 2002, in the name of Naoaki Furumiya.

Patent Abstracts of Japan, Publiction No. 2003-173165, dated Jun. 20, 2003, in the name of Aoki Yoshiaki.

Patent Abstracts of Japan, Publiction No. 2003-202833, dated Jul. 18, 2003, in the name of Hajime Kimura, et al.

Patent Abstracts of Japan, Publiction No. 2003-223138, dated Aug. 8, 2003, in the name of Hajime Kimura.

Patent Abstracts of Japan, Publiction No. 2004-133240, dated Apr. 30, 2004, in the name of Shin Asano.

* cited by examiner

ORGANIC LIGHT EMITTING DEVICE PIXEL CIRCUIT AND DRIVING METHOD THEREFOR

CROSS-REFERENCE TO RELATED APPLICATION

This application claims the benefit of Korean Patent Application No. 2003-45610, filed Jul. 7, 2003, the disclosure of which is hereby incorporated herein by reference in its entirety.

BACKGROUND OF THE INVENTION

1. Field of the Invention

The present invention relates to a flat panel display and, more specifically, to a pixel circuit in an organic light emitting device capable of realizing high gradation by self-compensating a threshold voltage of a transistor that drives an electroluminescent (EL) element, and a method for driving the same.

2. Description of the Related Art

Normally, an organic light emitting device may be classified into a passive matrix organic light emitting diode (OLED) and an active matrix OLED (AMOLED), and can be classified into a current driving OLED and a voltage driving OLED depending on the manner in which the EL element is driven.

A typical AMOLED is generally composed of a plurality of gate lines, a plurality of data lines, a plurality of power lines, and a plurality of pixels connected to the lines and arranged in a matrix form. Each pixel is normally composed of: an EL element; two transistors, in which one is a switching transistor for transferring a data signal while the other is a driving transistor for driving the EL element depending on the data signal; and one capacitor for maintaining the data voltage.

Although this AMOLED has an advantage in that power consumption is low, current intensity flowing through the EL element changeing over time, causing display nonuniformity, can be a problem. This results from a change in voltage between the gate and the source of the driving transistor for driving the EL element, namely, the threshold voltage of the driving transistor, which leads to a change in the current flowing through the EL element. Since the threshold voltage of a thin film transistor for the driving transistor changes depending on manufacturing process parameters, it becomes difficult to manufacture transistors in the AMOLED so that all of the transistors have the same threshold voltage. Thus, there are threshold voltage deviations between pixels.

In order to solve this voltage deivation problem, a method has been developed for compensating the threshold voltage depending on manufacturing process parameters by adding a transistor for threshold voltage compensation. U.S. Pat. No. 6,229,506 ('506 patent) discloses an organic light emitting device for compensating the threshold voltage deviation. The '506 patent discloses a pixel structure in which a current source adjusts a voltage between the source and the gate of a driving transistor with respect to an overdrive voltage thereof and compensates the threshold voltage deviation of the driving transistor. The organic light emitting device in the '506 patent performs a two-step operation involving a data load (data write) step and a continuous light-emitting step, in which a current source adjusts a voltage between the source and the gate of the driving transistor with respect to the overdrive voltage and compensates the threshold voltage deviation of the driving transistor.

However, the organic light emitting device as described above employs a current driving approach for driving the EL element which depends on a data signal current level applied from the current source and has difficulty in charging a data line. Because a parasitic capacitance of the data line is relatively larger while the current level of the data signal provided from the current source is relatively smaller, the data becomes unstable as well as considerably long time is required to charge the data line.

In order to solve the data line charging problem in the current driving approach, an organic light emitting device having a mirror type pixel structure has been proposed. FIG. 1 shows a pixel circuit of a voltage driving manner having a mirror type in a conventional voltage driving organic light emitting device.

Referring to FIG. 1, the pixel circuit comprises first P-type transistor T11 in which the gate of the first transistor is connected to current scan signal SCAN[n] applied to an associated scan line of a plurality of gate lines. Data signal VDATAm applied to an associated data line of a plurality of data lines is applied to its source. Second P-type transistor T12 in which a previous scan signal SCAN[n-1] is applied to a scan line just before the current scan line is applied to its gate. Initialization voltage Vinti is applied to its drain. Third and fourth P-type transistors T13 and T14 have a mirror type configuration. Fifth N-type transistor T15 in which previous scan signal SCAN[n-1] is applied to its gate has its drain coupled to the drain of fourth transistor T14. EL element EL11 is connected between fifth transistor T15 and ground voltage VSS. First capacitor C11 is connected between the gate and the source of fourth transistor T14.

Operation of the pixel in the organic light emitting device having the above-described structure will be described with reference to an operation waveform diagram of FIG. 2. Here, it is assumed that a scan line to be currently driven is the n-th scan line. A scan signal applied to the n-th scan line is SCAN [n]. A scan line driven before the current scan line is the (n-1)th scan line. A scan signal applied to the (n-i)th scan line is SCAN[n-1].

First of all, in initializing the operation, if predetermined levels of previous scan signal SCAN[n-1] and current scan signal SCAN[n] are applied thereto, that is, if a low level of previous scan signal SCAN[n-1] and a high level of current scan signal SCAN[n] are applied thereto, transistor T12 is turned on and transistors T11 and T15 are turned off, such that mirror-type transistors T13 and T14 are also turned off. Accordingly, the data stored in capacitor C11 is initialized through transistor T12 to initialization voltage Vinti.

Meanwhile, in programming data, if predetermined levels of previous scan signal SCAN[n-1] and current scan signal are applied thereto, that is, if a high level of previous scan signal SCAN[n-1] and a low level of current scan signal SCAN[n] are applied thereto, transistor T12 is turned off and transistor T11 is turned on, such that mirror-type transistors T13 and T14 are turned on.

Thus, a data signal voltage level VDATAm applied to the data line is transferred through transistor T13 to the gate of driving transistor T14. At this time, since transistor T15 is turned on by previous scan signal SCAN[n-1], a driving current corresponding to the data signal voltage VDATAm applied to the gate of driving transistor T14 flows into EL element EL 11 for its light-emitting.

The voltage applied to the gate of transistor T14 becomes VDATA-$V_{TH(T13)}$, and the current flowing through EL element EL11 is represented by the following Expression 1.

$$I_{EL11} = \frac{\beta}{2}\left(V_{GS(T14)} - V_{TH(T14)}\right)^2 \quad (1)$$
$$= \frac{\beta}{2}\left(V_{DD} - V_{DATA} + V_{TH(T13)} - V_{TH(T14)}\right)^2$$

Where, $I_{EL\ 11}$ represents the current flowing through organic EL element EL 11, $V_{GS(T14)}$ represents a voltage between the source and the gate of transistor T14, $V_{TH(13)}$ represents a threshold voltage of transistor T13, $V_{DATA}$ represents a data voltage, and β represents a constant value, respectively.

At this time, if threshold voltages of transistors T13 and T14 for the current mirror are identical with each other, i.e., if $V_{TH(T13)}=V_{TH(T14)}$, the threshold voltage of the transistor can be compensated, thereby maintaining the driving current of EL element EL 11 to be uniform.

However, although transistors T13 and T14 configuring the current mirror are arranged adjacent to each other on a substrate in the voltage driving manner of the current mirror type as described above, it is very difficult to obtain the same threshold voltage due to the manufacturing process parameters of TFT. Therefore, there is a problem that it is difficult to obtain a uniform driving current due to deviation of the threshold voltage of TFT, resulting in degraded image quality.

A technique for solving the image quality degradation due to the threshold voltage deviation between TFTs for the current mirror in the voltage driving manner of the current mirror type as described above is disclosed in U.S. Pat. No. 6,362,798 ('798 patent). In the '798 patent, a compensating thin film transistor having a diode form is connected to a gate of the driving transistor in order to compensate the threshold voltage of the driving transistor. However, there is a problem with the '798 patent that when threshold voltages of the thin film transistor for compensation and the thin film transistor for driving EL element drive are different from each other, threshold voltage deviation of the driving transistor is not compensated, as well.

SUMMARY OF THE INVENTION

The present invention, therefore, addresses the aforementioned problem of the prior art, and provides a pixel circuit in an organic light emitting device capable of detecting and self-compensating threshold voltage deviations, and a method for driving the same.

Further in accordance with the present invention a pixel circuit in an organic light emitting device is provided capable of compensating threshold voltage deviations regardless of manufacturing process parameters, and a method for driving the same.

Still further in accordance with the present invention a pixel circuit in an organic light emitting device is provided which is capable of allowing a driving current flowing through an EL element to be uniform regardless of threshold voltage deviation between respective pixels, and a method for driving the same.

Yet still further in accordance with the present invention a pixel circuit in an organic light emitting device is provided capable of realizing high gradation representation regardless of threshold voltage deviation between respective pixels, and a method for driving the same.

According to one aspect of the invention, there is provided a pixel circuit in an organic light emitting device. A first transistor delivers a data signal voltage in response to a current scan line signal. A second transistor generates a driving current depending on the data signal voltage delivered through the first transistor. A third transistor detects and self-compensates threshold voltage deviations in the second transistor. A capacitor for stores the data signal voltage delivered to the second transistor. An electroluminescent element emits light corresponding to the driving current generated through the second transistor.

According to another aspect of the invention, there is provided a pixel circuit in an organic light emitting device. A first transistor delivers a data signal voltage in response to a current scan line signal. A second transistor programs the data signal voltage and generates a driving current in response to the programmed data signal when light is emitted. A third transistor provides the data signal voltage for the second transistor in response to the current scan signal. A capacitor maintains the data signal voltage programmed onto the second transistor. A fourth transistor delivers a power supply voltage to the second transistor when the light is emitted. A fifth transistor delivers the driving current, provided from the second transistor, depending on the data signal voltage when the light is emitted. An electroluminescent element emits light corresponding to the driving current delivered through the fifth transistor. The third transistor connects the second transistor in the form of a diode in response to the current scan signal, so that the second transistor detects and compensates its threshold voltage deviation in itself.

The first transistor is composed of a PMOS transistor including a gate to which the current scan line signal is applied, a source to which the data signal voltage is applied, and a drain coupled to the second transistor. The second transistor is composed of a PMOS transistor including a gate coupled to one terminal of the capacitor, a source coupled to the first transistor, and a drain coupled to the electroluminescent element. The third transistor is composed of a PMOS transistor including a gate to which the current scan signal is applied, and a drain and a source which are coupled to the gate and the drain of the second transistor, respectively, so that the second transistor is connected in the form of a diode in response to the current scan signal to self-compensate a threshold voltage of the second transistor. The fourth transistor is composed of a PMOS transistor including a gate to which the current light-emitting signal is applied, a source to which a power supply voltage is applied, and a drain coupled to the second transistor. The fifth transistor is composed of a PMOS transistor including a gate to which the current light-emitting signal is applied, a source coupled to the second transistor, and a drain coupled to the electroluminescent element.

According to yet another aspect of the invention, there is provided pixel circuit in an organic light emitting device. An electroluminescent element emits light depending on an applied driving current. A first transistor delivers a data signal voltage in response to a current scan line signal. A second transistor for generates a driving current to drive the electroluminescent element in response to the data signal voltage. A third transistor connects the second transistor in the form of a diode in response to a current scan signal to self-compensate a threshold voltage of the second transistor. A capacitor stores the data signal voltage delivered to the second transistor. A fourth transistor delivers a power supply voltage to the second transistor in response to a current light-emitting signal. A fifth transistor provides the driving current, provided from the second transistor, for the electroluminescent element in response to the current light-emitting signal.

According to yet still another aspect of the invention, there is provided a pixel circuit in an organic light emitting device.

A first transistor includes a gate to which a current scan signal is applied, and a source to which a data signal voltage is applied. A second transistor has its source coupled to a drain of the first transistor. A third transistor has its drain and source connected between a gate and a drain of the second transistor. A fourth transistor includes a gate to which a current light-emitting signal is applied, a source to which a power supply voltage is applied, and a drain coupled to the source of the second transistor. A fifth transistor includes a gate to which the current light-emitting signal is applied, a source coupled to the drain of the second transistor, and a drain coupled to one terminal of an electroluminescent element. The electroluminescent element has one terminal coupled to the drain of the fifth transistor and the other terminal grounded. A capacitor has one terminal coupled to the gate of the second transistor. A power supply voltage is applied to the other terminal of the capacitor.

According to yet still another aspect of the invention, there is provided a pixel circuit in an organic light emitting device having a plurality of data lines, a plurality of scan lines, a plurality of power lines, and a plurality of pixels each connected to one associated data line, scan line and power line of the plurality of data lines, scan lines and power lines. Each pixel comprises: a first transistor including a gate to which a current scan signal to be applied to the associated scan line is applied, and a source to which a data signal voltage from the data line is applied; a second transistor whose source is coupled to a drain of the first transistor; a third transistor whose drain and source are connected between a gate and a drain of the second transistor, respectively; a fourth emitting transistor including a gate to which a current light-emitting signal is applied, a source to which a power supply voltage from the power line is applied, and a drain coupled to the source of the second transistor; a fifth transistor including a gate to which the current light-emitting signal is applied, and a source coupled to the drain of the second transistor; an electroluminescent element including one terminal coupled to the drain of the fifth transistor and the other terminal grounded; and a capacitor including one terminal coupled to the gate of the second transistor, and the other terminal to which the power supply voltage from the power line is applied.

According to yet still another aspect of the invention, there is provided a method of driving a pixel in an organic light emitting device having a plurality of data lines, a plurality of scan lines, a plurality of power lines, and a plurality of pixels each connected to an associated one data line, scan line and power line of the plurality of data lines, scan lines and power lines. The method comprises: performing initialization in response to a scan signal applied to a scan line just before the associated scan line; compensating threshold voltage deviation in response to a scan signal applied to the associated scan line, and programming a data voltage applied from the associated data line, regardless of the threshold voltage deviation; and generating a driving current corresponding to the data voltage to emit an electroluminescent (EL) element in response to a current light-emitting signal.

DETAILED DESCRIPTION

Figure 1:
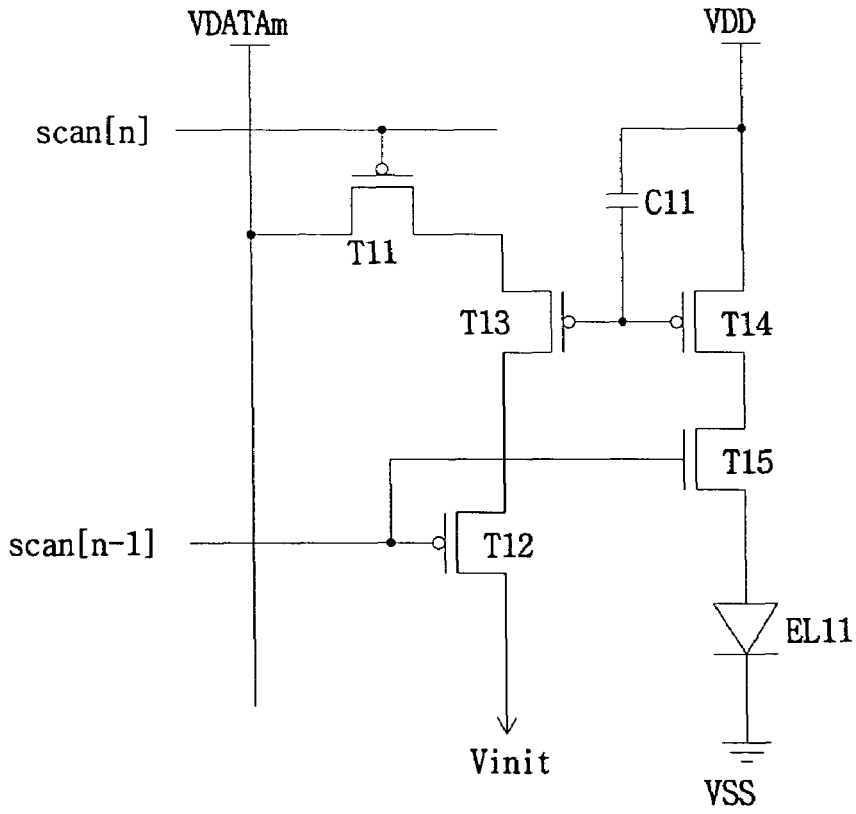
FIG. 1 (PRIOR ART)
FIG. 1 illustrates a circuit construction of a pixel in a conventional organic light emitting device.
Figure 2:
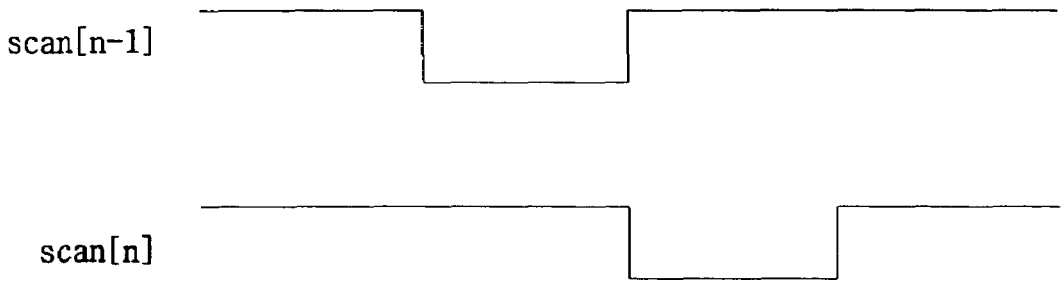
FIG. 2 (PRIOR ART)
FIG. 2 is a waveform diagram for explaining operation of the pixel in the conventional organic light emitting device.
Figure 3:
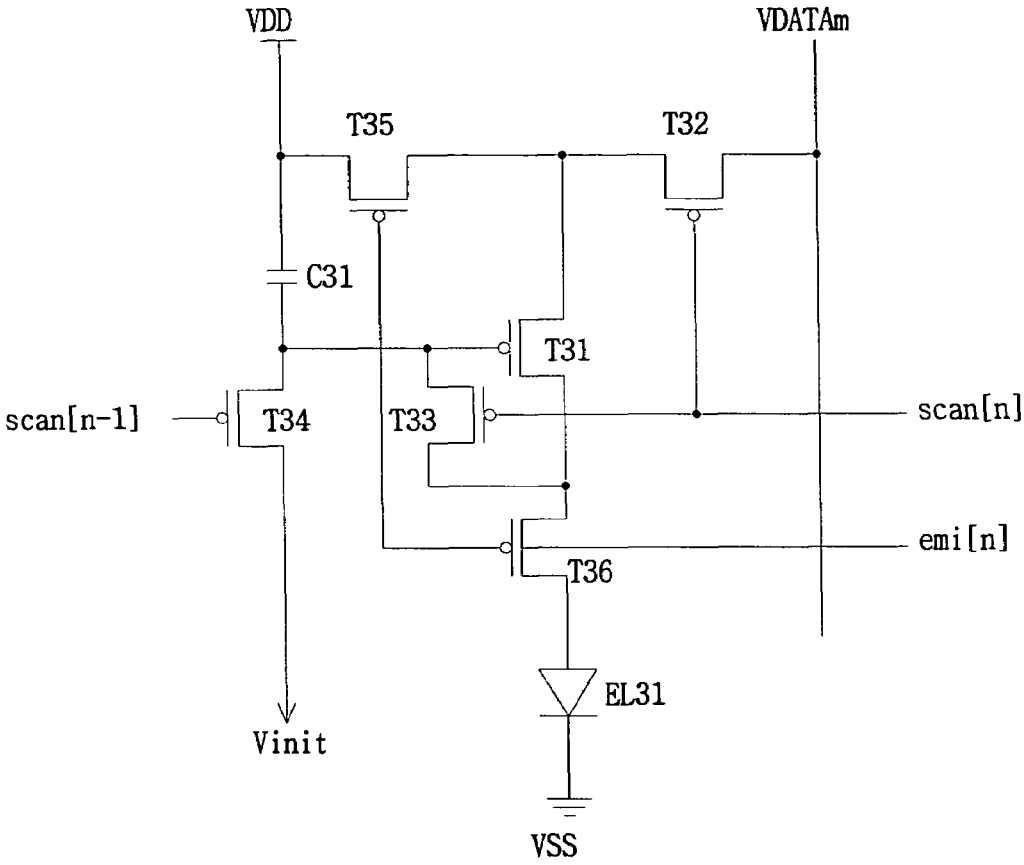
FIG. 3 illustrates a circuit construction of a pixel in an organic light emitting device according to an embodiment of the present invention.

The organic light emitting device in accordance with the present invention includes a plurality of gate lines; a plurality of data lines; a plurality of power lines; and a plurality of pixels each arranged in an associated gate line, data line and power line of the plurality of gate lines, data lines and power lines. FIG. 3 shows only one pixel arranged in an associated gate line (the n-th gate line), data line (the m-th data line) and power line (the m-th power line).

Referring to FIG. 3, each pixel in the organic light emitting device according to the present invention is composed of six transistors T31-T36, one capacitor C31 and electroluminescent (EL) element EL31. That is, each pixel includes organic electroluminescent device EL31 for emitting light corresponding to an applied driving current; first switching transistor T32 for switching data signal voltage VDATAm, applied to the associated data line, in response to current scan line signal SCAN[n] applied to the associated scan line; driving transistor T31 for supplying a driving current of the organic electroluminescent device corresponding to the data signal voltage inputted to its gate through first switching transistor T32; threshold voltage compensation transistor T33 for compensating the threshold voltage of driving transistor T31; and capacitor C31 for storing the data signal that is applied to the gate of driving transistor T31.

First switching transistor T32 is composed of a P-type thin film transistor in which current scan signal SCAN[n], applied to the associated scan line, is applied to its gate, data signal voltage VDATAm, applied to the associated data line, is applied to its source, and its drain is connected to the source of driving transistor T31.

Driving transistor T31 is composed of a P-type thin film transistor in which its gate is connected to one terminal of capacitor C31 and its drain is connected to one terminal of EL element EL31. Threshold voltage compensation transistor T33 is composed of a P-type thin film transistor in which its drain and source are connected to the gate and drain of driving transistor T31, respectively, and a current scan signal scan [n] is applied to the gate of transistor T33. Power supply voltage VDD from the associated power line is provided for the other side of capacitor C31.

Further, each pixel comprises second switching transistor T35 for providing power supply voltage VDD for driving transistor T31 in response to current light-emitting signal EMI[n], and third switching transistor T36 for providing a driving current, generated through driving transistor T31, for EL element EL31 in response to current light-emitting signal EMI[n].

Second switching transistor T35 is composed of a P-type thin film transistor in which current light-emitting signal EMI [n] is applied to its gate, the power supply voltage from the associated power supply voltage line is applied to its source, and its drain is connected to the source of driving transistor T32. Third switching transistor T36 is composed of a P-type thin film transistor in which current light-emitting signal EMI [n] is applied to its gate, its source is coupled to the drain of driving transistor T31, and the drain of transistor T36 is coupled to one terminal of EL element EL31. The other terminal of EL element EL31 is grounded.

Moreover, each pixel includes initialization transistor T34 for initializing the data signal stored in capacitor C31 in response to a previous scan signal SCAN[n-1] applied to a scan line just before the associated scan line. Transistor T34 is composed of a P-type thin film transistor in which previous scan signal SCAN[n-1] is applied to its gate, its source is coupled to the one terminal of capacitor C31, and initialization voltage Vinti is applied to its drain.

Operation of the pixel having the above-described configuration according to the present invention will be described with reference to FIGS. 4 to 7.

Figure 4:
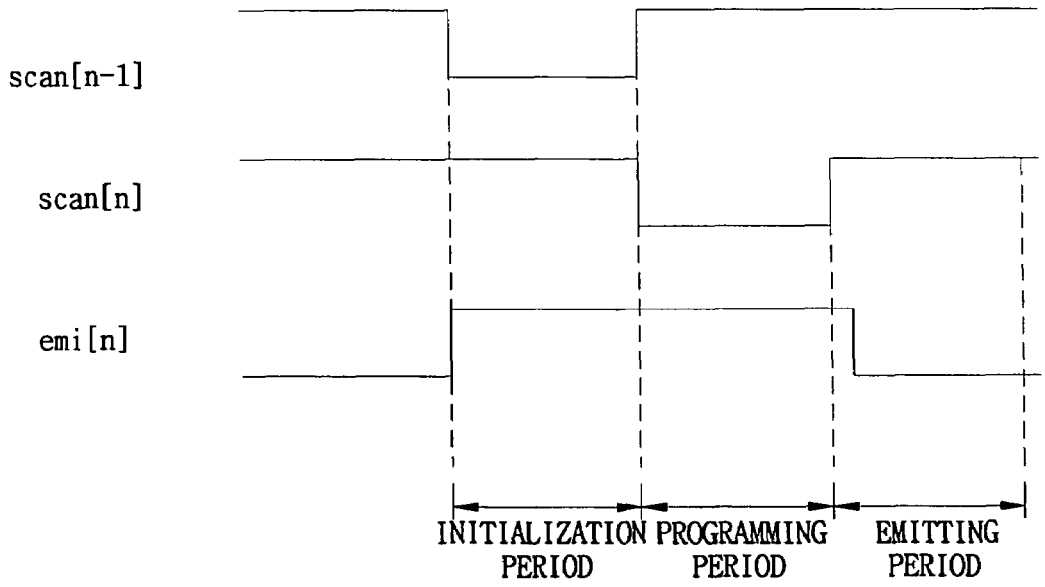
FIG. 4 is a waveform diagram for explaining operation of the pixel in the organic light emitting device according to the embodiment of the present invention, as shown in FIG. 3.
Figure 5:
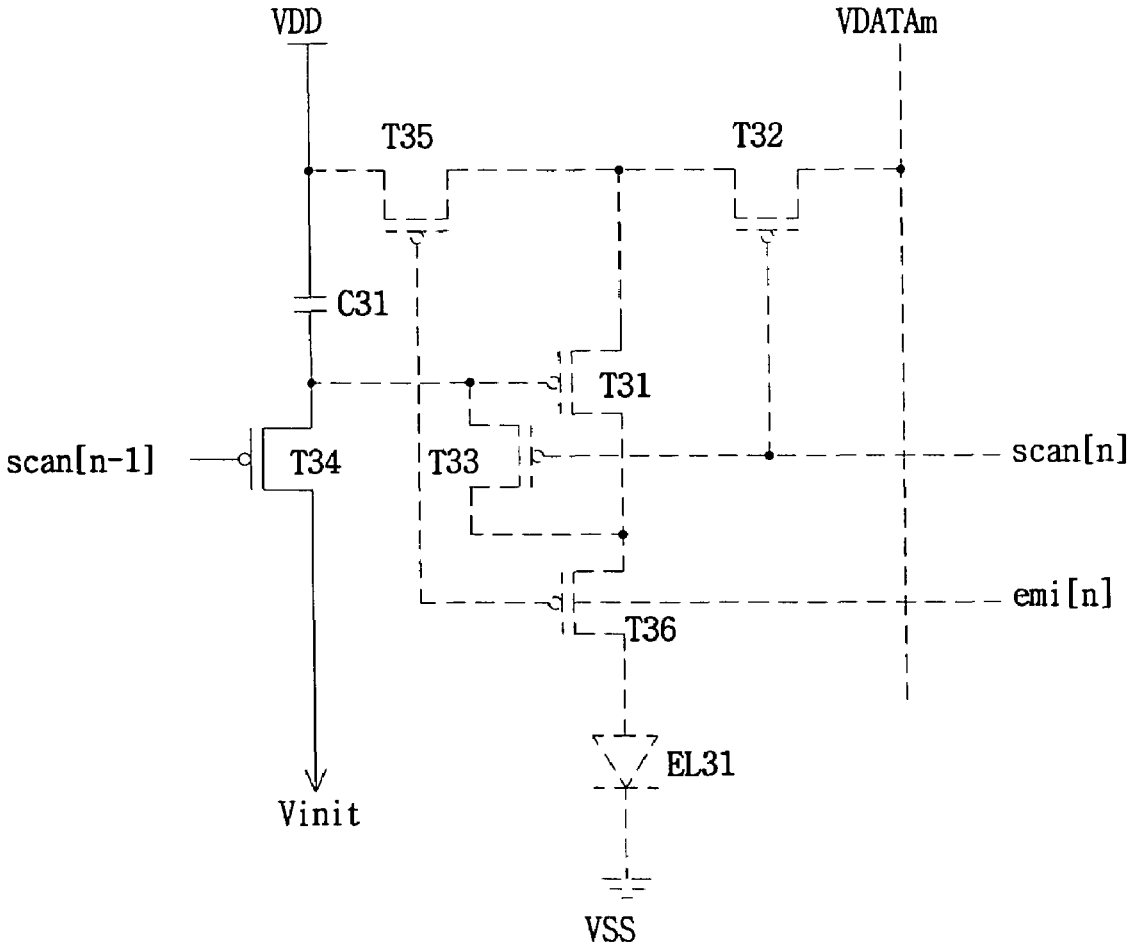
FIGS. 5 to 7 are circuit construction diagrams for explaining initialization operation, program operation and light-emitting operation of a pixel in an organic light emitting device according to an embodiment of the present invention.
Figure 6:
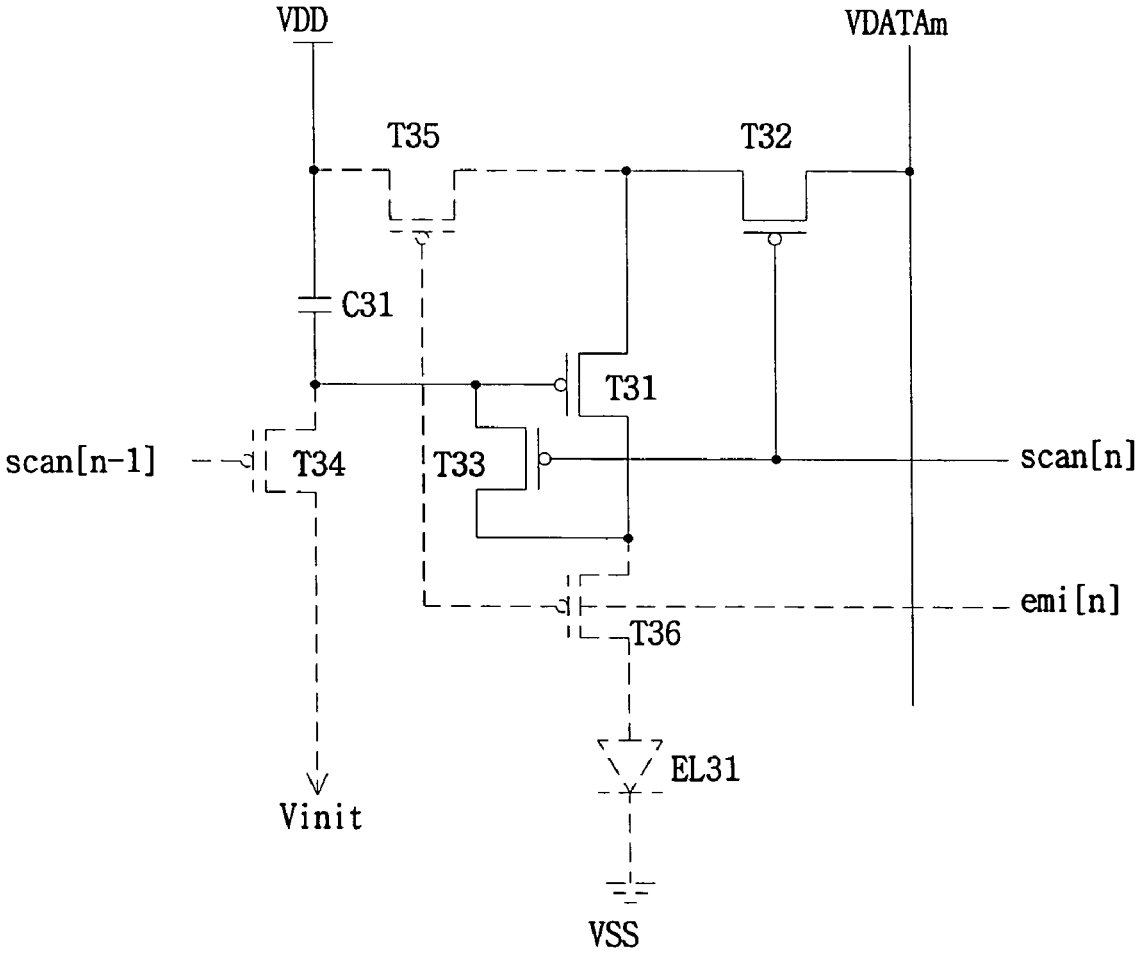

First, in an initialization operation, during an initialization period in which previous scan signal SCAN[n-1] is of a low level, and current scan signal SCAN[n] and light-emitting signal EMI[n] are of high level as shown in FIG. 4, since transistor T34 is turned on by the low level of previous scan signal SCAN[n-1], and transistors T31-T33 and T35-T36 are turned off by the high level of current scan signal SCAN[n] and current light-emitting signal EMI[n], an initialization path (as indicated by a solid line shown in FIG. 5) is formed. Accordingly, the data signal that has been stored in capacitor C31, namely, a gate voltage of driving transistor T31, is initialized.

Next, in a data program operation, during a programming period in which previous scan signal scan [n-1] is at a high level, current scan signal SCAN[n] is at a low level and current light-emitting signal EMI[n] is at a high level as shown in FIG. 4, transistor T34 is turned off, and transistor T33 is turned on by the low level of current scan signal SCAN[n], such that driving transistor T31 is connected in the form of a diode.

Since switching transistor T32 is also turned on by current scan signal SCAN[n], and switching transistors T35 and T36 are turned off by current light-emitting signal EMI[n], such that a data program path (as indicated by a solid line shown in FIG. 6) is formed. Accordingly, data voltage VDATAm applied to the associated data line is provided for the gate of driving transistor T31 through threshold voltage compensation transistor T33.

Since driving transistor T31 is in the diode connection, VDATAm-$V_{TH(T31)}$ is applied to the gate of transistor T31 and the gate voltage is stored in capacitor C31, such that the program operation is completed.

Figure 7:
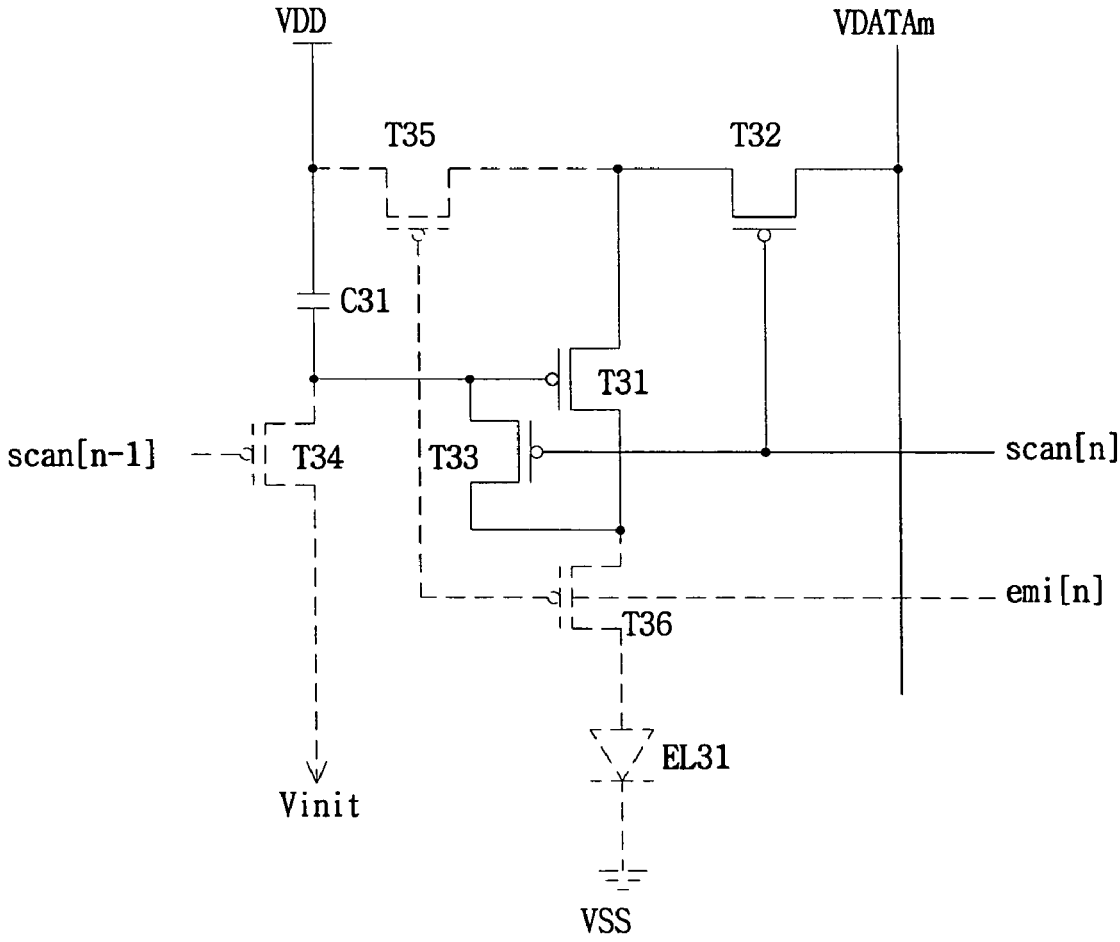

Finally, in a light-emitting operation, during an light-emitting period in which previous scan signal SCAN[n-1] is of high level, current scan signal SCAN[n] becomes a high level, and then current light-emitting signal EMI[n] becomes a low level as shown in FIG. 4, an light-emitting path (as indicated by the solid line as shown in FIG. 7) is formed. That is, switching transistors T35 and T36 are turned on by the low level of current light-emitting signal EMI[n], initialization transistor T34 is turned off by the high level of previous scan signal SCAN[n-1], and threshold voltage compensation transistor T33 and switching transistor T32 are turned off by the high level of current scan signal SCAN[n]. Accordingly, a driving current generated in response to the data signal voltage applied to the gate of driving transistor T31 is provided through transistor T31 for organic EL element EL31, such that the light-emitting of organic EL element EL31 occurs.

At this time, the current into organic EL element EL31 is represented by the following Expression 2.

$$I_{EL31} = \frac{\beta}{2}(V_{GS} - V_{TH(M31)})^2 = \frac{\beta}{2}(V_{DD} - V_{DATA} + V_{TH(M31)} - V_{TH(M31)})^2 \quad (2)$$

Where, $I_{EL31}$ represents the current flowing into organic EL element EL31, $V_{GS}$ represents a voltage between the source and the gate of transistor T31, $V_{TH(T31)}$ represents a threshold voltage of transistor T31, $V_{DATA}$ represents a data voltage, and β represent a constant value, respectively.

As can be seen from the Expression 2, the driving current flows through EL element EL31, corresponding to the data signal voltage applied to the data line regardless of the threshold voltage of current driving transistor T31. That is, because the present invention detects and self-compensates the threshold voltage deviation in current driving transistor T31 through transistor T33, it is possible to finely control the current flowing into the organic EL element, thereby providing the high gradation of the organic EL element.

Further, if the data for a previous frame time has a high level of voltage and the data for a next frame time has a low level of voltage, the data signal can be no longer applied to the gate node of transistor T31 owing to the diode connection property of transistor T31, and thus switching transistor T34 is placed to initialize the gate node of transistor T31 into a predetermined level Vinti per frame.

As described above, driving transistor T31 in the present invention can self-compensate the threshold voltage deviation by detecting its own threshold voltage.

Although the embodiment of the present invention illustrates the pixel circuit composed of six transistors and one capacitor, the present invention is applicable to all constructions for detecting and self-compensating a threshold voltage. Moreover, the pixel circuit can be configured of a NMOS transistor, a CMOS transistor or the like other than the PMOS transistor.

According to the embodiment of the present invention as described above, there are advantages that it is possible to realize high gradation by detecting and self-compensating the threshold voltage deviation in the driving transistor as well as to solve a charging problem in the data line by driving the driving transistor in the voltage driving manner.

Although the present invention has been described with reference to the exemplary embodiments thereof, it will be appreciated by those skilled in the art that it is possible to modify and change the present invention variously without departing from the spirit and scope of the present invention as set forth in the following claims.

What is claimed is:

1. A pixel circuit in an organic light emitting device, comprising:

a first transistor for delivering a data signal voltage in response to a current scan line signal;

a second transistor for generating a driving current depending on the data signal voltage delivered through the first transistor;

a third transistor for detecting and self-compensating threshold voltage deviation in the second transistor;

a fifth transistor for providing a power supply voltage for the second transistor in response to a current light-emitting signal;

a sixth transistor which is coupled in series between the second transistor and an electroluminescent element and for providing the driving current for the electroluminescent element through the second transistor in response to the current light-emitting signal; and a capacitor for storing the data signal voltage delivered to the second transistor, wherein the electroluminescent element emitts light corresponding to the driving current generated through the second transistor.

2. The pixel circuit in the organic light emitting device of claim 1, further comprising:

a fourth initialization transistor for discharging the data signal voltage stored in the capacitor in response to a scan signal just before the current scan signal.

3. The pixel circuit in the organic light emitting device of claim 1, wherein the first transistor is composed of a PMOS transistor including a gate to which the current scan line signal is applied, a source to which the data signal voltage is applied, and a drain coupled to the second transistor.

4. The pixel circuit in the organic light emitting device of claim 1, wherein the second transistor is composed of a PMOS transistor including a gate coupled to one terminal of the capacitor, a source coupled to the first transistor, and a drain coupled to the electroluminescent element.

5. The pixel circuit in the organic light emitting device of claim 4, wherein the third transistor is composed of a PMOS transistor including a gate to which the current scan signal is applied, and a drain and a source which are coupled to the gate and the drain of the second transistor, respectively, so that the third transistor connects the second transistor in the form of a diode in response to the current scan signal to self-compensate a threshold voltage of the second transistor.

6. The pixel circuit in the organic light emitting device of claim 1, further comprising:

a voltage source for providing the data signal voltage through the first transistor for the second transistor.

7. A pixel circuit in an organic light emitting device, comprising:

a first transistor for delivering a data signal voltage in response to a current scan line signal;

a second transistor for programming the data signal voltage and for generating a driving current in response to a programmed data signal when light is emitted;

a third transistor for providing the data signal voltage for the second transistor in response to the current scan signal;

a capacitor for maintaining the data signal voltage programmed onto the second transistor;

a fourth transistor for delivering a power supply voltage to the second transistor when the light is emitted;

a fifth transistor for delivering the driving current, provided from the second transistor, in response to the data signal voltage when the light is emitted; and an electroluminescent element for emitting light corresponding to the driving current delivered through the fifth transistor, wherein the third transistor connects the second transistor in the form of a diode in response to the current scan signal so that the second transistor detects and compensates its threshold voltage deviation in itself.

8. The pixel circuit in the organic light emitting device of claim 7, further comprising:

a sixth initialization transistorfor discharging the data signal voltage stored in the capacitor in response to a scan signal just before the current scan signal upon initialization.

9. The pixel circuit in the organic light emitting device of claim 7, wherein the first transistor is composed of a PMOS transistor including a gate to which the current scan line signal is applied, a source to which the data signal voltage is applied, and a drain coupled to the second transistor.

10. The pixel circuit in the organic light emitting device of claim 7, wherein the second transistor is composed of a PMOS transistor including a gate coupled to one terminal of the capacitor, a source coupled to the first transistor, and a drain coupled to the electroluminescent element.

11. The pixel circuit in the organic light emitting device of claim 10, wherein the third transistor is composed of a PMOS transistor including a gate to which the current scan signal is applied, and a drain and a source which are coupled to the gate and the drain of the second transistor, respectively, so that the third transistor connects the second transistor in the form of a diode in response to the current scan signal to self-compensate a threshold voltage of the second transistor.

12. The pixel circuit in the organic light emitting device of claim 7, further comprising:

a voltage source for providing the data signal voltage through the first transistor for the second transistor.

13. The pixel circuit in the organic light emitting device of claim 7, wherein the fourth transistor is composed of a PMOS transistor including a gate to which the current light-emitting signal is applied, a source to which a power supply voltage is applied, and a drain coupled to the second transistor; and the fifth transistor is composed of a PMOS transistor including a gate to which the current light-emitting signal is applied, a source coupled to the second transistor, and a drain coupled to the electroluminescent element.

14. A pixel circuit in an organic light emitting device, comprising:

an electroluminescent element for emitting light in response to an applied driving current;

a first transistor for delivering a data signal voltage in response to a current scan line signal;

a second transistor for generating a driving current to drive the electroluminescent element in response to the data signal voltage;

a third transistor for connecting the second transistor in the form of a diode in response to the current scan signal to self-compensate a threshold voltage of the second transistor;

a capacitor for storing the data signal voltage delivered to the second transistor;

a fourth transistor for delivering a power supply voltage to the second transistor in response to a current light-emitting signal; and a fifth transistor for providing the driving current, provided from the second transistor, for the electroluminescent element in response to the current light-emitting signal.

15. A pixel circuit in an organic light emitting device, comprising:

a first transistor including a gate to which a current scan signal is applied, and a source to which a data signal voltage is applied;

a second transistor whose source is coupled to a drain of the first transistor;

a third transistor whose drain and source are connected between a gate and a drain of the second transistor;

a fourth transistor including a gate to which a current light-emitting signal is applied, a source to which a power supply voltage is applied, and a drain coupled to the source of the second transistor;

a fifth transistor including a gate to which the current light-emitting signal is applied, a source coupled to the drain of the second transistor, and a drain coupled to one terminal of an electroluminescent element;

the electroluminescent element having the one terminal coupled to the drain of the fifth transistor and the other terminal grounded; and a capacitor in which one terminal of the capacitor is coupled to the gate of the second transistor and a power supply voltage is applied to the other terminal of the capacitor.

16. The pixel circuit in the organic light emitting device of claim 15, further comprising:

a sixth transistor including a gate to which a scan signal just before the current scan signal is applied;

a source coupled to the one terminal of the capacitor; and a drain to which an initialization voltage is applied.

17. A pixel circuit in an organic light emitting device having a plurality of data lines, a plurality of scan lines, a plurality of power lines, and a plurality of pixels each connected to one associated data line, scan line and power line of the plurality of data lines, scan lines and power lines, each pixel comprising:

a first transistor including a gate to which a current scan signal to be applied to the associated scan line is applied, and a source to which a data signal voltage from the data line is applied;

a second transistor whose source is coupled to a drain of the first transistor;

a third transistor whose drain and source are connected between a gate and a drain of the second transistor, respectively;

a fourth emitting transistor including a gate to which a current light-emitting signal is applied, a source to which a power supply voltage from the power line is applied, and a drain coupled to the source of the second transistor;

a fifth transistor including a gate to which the current light-emitting signal is applied, and a source coupled to the drain of the second transistor;

an electroluminescent element including one terminal coupled to the drain of the fifth transistor and the other terminal grounded; and a capacitor including one terminal coupled to the gate of the second transistor, and the other terminal to which the power supply voltage from the power line is applied.

18. The pixel circuit in the organic light emitting device of claim 17, further comprising:

a sixth transistor including a gate to which a scan signal to be applied to a scan line just before the associated scan line is applied, a source coupled to the one terminal of the capacitor, and a drain to which an initialization voltage is applied.

* * * * *